United States Patent [19]

Beckway et al.

[11] Patent Number: 4,768,704

[45] Date of Patent: Sep. 6, 1988

[54] BUTTON FASTENER

[75] Inventors: Bruce C. Beckway, River Forest; James D. Fox, Homewood, both of Ill.

[73] Assignee: Packing Materials Corporation, Chicago, Ill.

[21] Appl. No.: 44,222

[22] Filed: Apr. 30, 1987

[51] Int. Cl.[4] ..... B65D 55/60

[52] U.S. Cl. ..... 229/125.38; 24/107; 24/297; 24/704; 229/125.22; 229/125.39

[58] Field of Search ..... 229/125.21, 125.22, 229/125.23, 125.37, 125.38, 125.39; 24/107, 265 EC, 265 H, 265 AL, 297, 453, 588, 701, 704

[56] References Cited

U.S. PATENT DOCUMENTS

| | | | |
|---|---|---|---|
| 64,654 | 5/1867 | Floyd | 24/704 |
| 206,037 | 7/1878 | Mumford | 24/107 |
| 526,112 | 9/1894 | Molly | 24/704 |
| 1,473,942 | 11/1923 | Strauss | 229/125.22 |
| 1,574,737 | 2/1926 | Fellowes | 229/125.38 |
| 2,813,712 | 11/1957 | Stanis | 24/107 |
| 3,262,168 | 7/1966 | Overhoff | 24/297 |
| 4,240,183 | 12/1980 | Sumimoto et al. | 24/704 |

FOREIGN PATENT DOCUMENTS

| | | | |
|---|---|---|---|
| 2713650 | 10/1978 | Fed. Rep. of Germany | 24/704 |
| 979588 | 4/1951 | France | 24/107 |

*Primary Examiner*—Stephen Marcus
*Assistant Examiner*—Gary E. Elkins
*Attorney, Agent, or Firm*—Robert E. Knechtel; Basil E. Demeur

[57] ABSTRACT

A button fastener for use with a storage carton having a stud on one button member which is extended through the side wall of the storage carton. Another button member then is engaged with the stud so as to receive the stud in a bore in it and the two button members are pressed together to force the stud through the bore until locking shoulders formed by an enlarged head on the stud and the cavity about the bore lockingly engage with one another to affix the two button members together. A longitudinal slot in the stud and the enlarged head on it permits the enlarged head to be sufficiently compressed together to be extended into and through the bore, and to then expand to engage the locking shoulders. Conical walls of the enlarged head also assist in inserting the enlarged head into the bore. The enlarged head on the stud is contained substantially or completely within the cavity about the bore and is thereby prevented from puncturing or otherwise damaging the side walls of the storage carton.

4 Claims, 1 Drawing Sheet

BUTTON FASTENER

This invention relates to an improved button fastener for use with a storage carton of the type having top flaps for closing the open top of the carton, at least one of the top flaps having a string affixed to it which can be wrapped about the button fastener to secure the top flaps closed over the open top of the carton.

In the past, button fasteners have been used to secure the top flaps closed over the open top of a storage carton as described above. However, the button fasteners secured to the storage carton for this purpose have generally consisted of a button member having a body portion with a stud extending perpendicular from it, and a washer member having a bore in it for receiving therethrough the stud on the button member. The storage cartons normally are stored and shipped in a knock-down configuration. In many instances, when stored or shipped in this fashion, the ends of the studs puncture the side walls of the storage cartons. Purchasers find this to be quite objectionable. For this reason and others, the carbon manufacturers for some time have desired an improved fastener for these cartons.

Accordingly, it is an object of the present invention to provide an improved button fastener for use with storage cartons. In particular, it is an object to provide such a button fastener which will not puncture the side walls of the storage carton.

The above objectives are accomplished with the button fastener of the present invention which is of a two-piece construction including a first button member having, as illustrated, a body portion which is circular-shaped and a stud extending perpendicularly from it. The stud has an enlarged head on its terminal end which preferably has conical side walls that taper outwardly from the terminal end of the head toward the body portion. A slot is formed in the head and the stud and extends longitudinally through at least part of the stud. One end of the enlarged head forms a locking shoulder about the stud.

The other member of the button fastener is a washer-like member having a body portion which likewise, as illustrated, is circular-shaped and has a circular-shaped stem of a reduced diameter extending perpendicularly from it. A bore which is proportioned to receive therein the enlarged head on the stud on the other fastener member is formed through the body portion and the stem. A cavity is formed about the bore in the body portion and forms a locking shoulder engageable with the locking shoulder on the stud of the other fastener member. The depth of the cavity preferably corresponds to the length of the enlarged head on the stud so that when the two locking shoulders are engaged, the end of the stud and enlarged head are completely contained within the bore and the cavity when the two button members are affixed together. In this respect, the thickness of the body portion, the length of the stem, and the length of the stud with the enlarged head on it are all proportioned such that the distance or spacing between the body portions on the two button members when they are affixed together by engaging the locking shoulders on them substantially correspond to the thickness of the material from which the storage carton is formed.

In affixing the button fastener to the storage carton, the stud on the one button member is extended through the side wall of the storage carton in a desired location.

A hole for receiving the stud can be pre-formed in the carton for this purpose. The other button member then is engaged with the stud so as to receive the stud in the bore in it and the two button members pressed together to force the stud through the bore until the locking shoulders formed by the enlarged head on the stud and the cavity about the bore lockingly engage with one another to affix the two button members together. The longitudinal slot in the stud and the enlarged head on it permits the enlarged head to be sufficiently compressed together to be extended into and through the bore, and to then expand to engage the locking shoulders. The conical walls of the enlarged head also assist in inserting the enlarged head into the bore. Since, as indicated above, the enlarged head on the stud is contained substantially or completely within the cavity about the bore, the stud is prevented from puncturing or otherwise damaging the side walls of the storage carton.

These and other features and improvements of the button fastener of the invention will become more apparent from the description below when considered in conjunction with the drawings.

DESCRIPTION OF A PREFERRED EMBODIMENT

Figure 1:
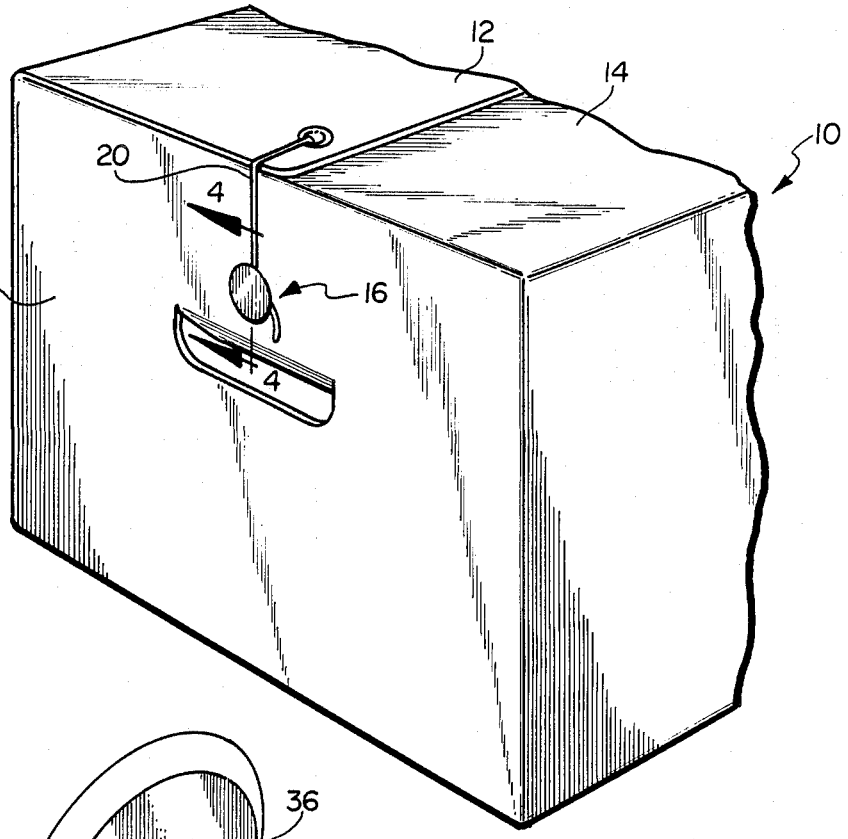
FIG. 1 is a partial perspective view of a storage carton illustrating one of the button fasteners thereon.
Figure 2:
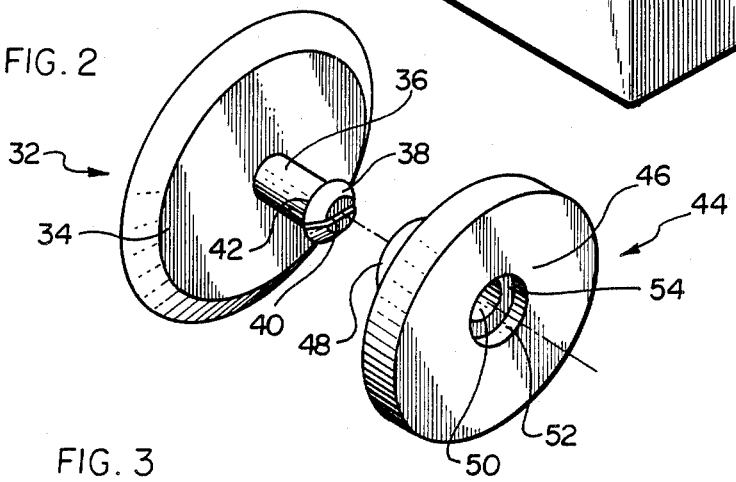
FIG. 2 is an exploded perspective view of the button fastener.

Referring now to the drawings, in FIG. 1 there is illustrated a storage carton 10 of the type having a pair of top flaps 12 and 14 for closing the open top of the carton. A button fastener 16 is affixed to at least one, but usually both end walls 18 of the carton 10, and a string 20 is affixed to one of the flaps 12 and 14 and is of sufficient length to be wrapped around the button half of the button fastener disposed outside of the carton to secure the top flaps closed over the open top of the carton, as illustrated.

Figure 3:
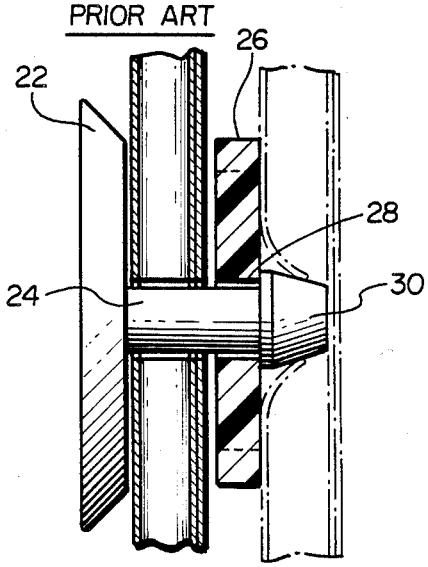
FIG. 3 PRIOR ART
FIG. 3 is a side plan view, partially sectionalized, of a button fastener of the prior art affixed to a storage carton.
Figure 4:
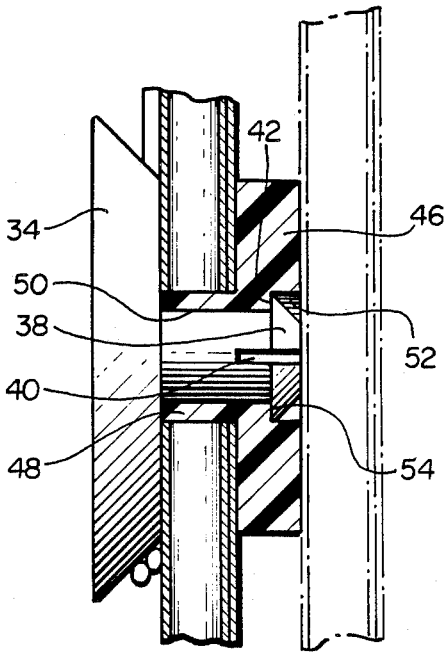
FIG. 4 is a side plan view, partially sectionalized, of the button fastener of the invention affixed to a storage carton.

In the past, the button fasteners used to secure the top flaps 12 and 14 closed over the open top of the cartons were of the construction illustrated in FIG. 3. These button fasteners have generally consisted of a button member having a body portion 22 having a stud 24 extending perpendicularly from it, and a washer 26 having a bore 28 through it for receiving therethrough the stud 24. The stud 24 has an enlarged head 30 on it which lockingly engages behind the washer 26 to secure the button fastener together and to the carton.

These storage cartons normally are stored and shipped in a knock-down configuration and, in many instances, the ends of the studs puncture or otherwise damage the side walls of the carton, as illustrated.

The button fastener 16 of the present invention is of a design and construction to eliminate this objectionable feature of the prior art button fasteners. It is a two-piece fastener and can easily be molded of plastic so that it is inexpensive. It has a first button member 32 having a body portion 34 which, as illustrated, is circular-shaped and has a stud 36 extending perpendicularly from it.

The stud 36 has an enlarged head 38 on its terminal end which preferably has conical side walls which taper outwardly from the terminal end thereof towards the body portion 34. A slot 40 is formed in the enlarged head 38 and extends longitudinally through at least part of the stud 36. The enlarged head 38 forms a locking shoulder 42 about the stud 36.

The other member 44 of the button fastener 16 is a washer-like member having a body portion 46 which likewise, as illustrated, is circular-shaped and has a circular-shaped stem 48 of a reduced diameter extending perpendicularly from it. A bore 50 which is proportioned to receive therein the enlarged head 38 on the stud 36 is formed through the body portion 46 and the stem 48. A cavity 52 is formed about the bore 50 in the body portion 46 and forms a locking shoulder 54 which is engageable with the locking shoulder 42 on the stud 36 when the button fastener 16 is assembled, as more fully described below. The cavity 52 preferably and advantageously has a depth corresponding to the length of the enlarged head 38 so that when the button fastener is assembled, the enlarged head is substantially and preferably completely contained within the cavity 52 when the locking shoulders 42 and 54 are engaged. Also, preferably the thickness of the body portion 46, the length of the stem 48, the length of the stud 36 with the enlarged head 38 on it are all proportioned such that the distance or spacing between the body portions 34 and 46 of the two button members when they are affixed together by engaging the locking shoulder 42 and 54 substantially correspond to the thickness of the material from which the storage carton is formed.

The button fastener 16 is affixed to a storage carton 10 by extending the stud 36 through a hole in the end wall 18 of the carton. The other button member 44 then is engaged with the stud 36 so as to receive the stud in the bore 50, and the two button members 32 and 34 simply are pressed together to force the stud 36 through the bore until the locking shoulders 42 and 54 lockingly engage with one another to affix the two button members together. When affixed together, the enlarged head 38 is contained within the cavity 52, and the stud 36 is prevented from puncturing the wall of the storage carton, as illustrated.

What is claimed is:

1. In combination with a storage carton having top flaps for closing the open top of said carton and at least one string affixed to at least one such top flap for securing said top flaps closed over the open top of said carton, a button fastener adopted to be affixed to said carton and around which said string is wrapped to secure said top flaps closed over the open top of said carton, said button fastener comprising:

a first button member having a body portion around which said string is wrapped and a stud extending perpendicularly therefrom, said stud having an enlarged head on the terminal end thereof, one end of said enlarged head forming a shoulder about said stud; and a second button member having a body portion with a stem extending perpendicularly therefrom, a bore extending through said body portion and said stem, said bore being smaller than said enlarged head on the terminal end of said stud on said first button member and proportioned to receive therein said stud of said first button member, an annular cavity in said body portion disposed axially about said bore and forming a shoulder engageable with said shoulder formed by said enlarged head;

said stud of said first button member having formed in it at least one slot extending longitudinally through a portion of its length, said slot permitting said enlarged head on said stud to be compressed together to permit said enlarged head to be extended into and through said bore in said second button member into said cavity, said enlarged head on said stud expanding within said cavity and said shoulder formed by said enlarged head lockingly engaging said shoulder formed by said cavity about said bore to thereby lockingly secure said first and second button members together;

said enlarged head being contained within said cavity about said bore when said first and second button members are affixed together, whereby said stud and said enlarged head thereon is prevented from puncturing a wall of the storage carton when the latter is collapsed for storage or shipment.

2. The button fastener of claim 1 wherein the terminal end of said stem on said second button member abuts against said first button member when said shoulder formed by said enlarged head is engaged with said shoulder formed by said cavity.

3. The button fastener of claim 2 wherein the spacing between the body portions of said first and second button member when affixed together substantially corresponds to the thickness of the material forming said carton.

4. The button fastener of claim 2 wherein the terminal end of said stud of said first button member is formed conical to assist in inserting said stud into said bore.

* * * * *